US008066867B2

(12) United States Patent
Dziabala et al.

(10) Patent No.: US 8,066,867 B2
(45) Date of Patent: Nov. 29, 2011

(54) COMBINATION OF MILD HYDROTREATING AND HYDROCRACKING FOR MAKING LOW SULFUR DIESEL AND HIGH OCTANE NAPHTHA

(75) Inventors: Bart Dziabala, Hickory Hills, IL (US); Vasant P. Thakkar, Elk Grove, IL (US); Suheil F. Abdo, Lincolnshire, IL (US)

(73) Assignee: UOP LLC, Des Plaines, IL (US)

( * ) Notice: Subject to any disclaimer, the term of this patent is extended or adjusted under 35 U.S.C. 154(b) by 378 days.

(21) Appl. No.: 12/268,048

(22) Filed: Nov. 10, 2008

(65) Prior Publication Data

US 2010/0116712 A1 May 13, 2010

(51) Int. Cl.
*C10G 45/00* (2006.01)
*C10G 45/021* (2006.01)

(52) U.S. Cl. ..... 208/57

(58) Field of Classification Search ..... 208/57
See application file for complete search history.

(56) References Cited

U.S. PATENT DOCUMENTS

| | | | | | |
|---|---|---|---|---|---|
| 3,272,734 | A | * | 9/1966 | MacLaren | 208/110 |
| 3,404,085 | A | * | 10/1968 | Hamner et al. | 208/111.35 |
| 3,620,962 | A | * | 11/1971 | Pfefferle | 208/111.35 |
| 3,720,601 | A | | 3/1973 | Coonradt et al. | 260/111 |
| 3,755,147 | A | | 8/1973 | Michelson | 208/112 |
| 4,302,323 | A | * | 11/1981 | Chen | 208/111.35 |
| 4,736,316 | A | | 4/1988 | Wallman | 364/149 |
| 4,738,766 | A | * | 4/1988 | Fischer et al. | 208/111.35 |

FOREIGN PATENT DOCUMENTS

| | | |
|---|---|---|
| EP | 0949318 | 10/1999 |
| GB | 1077312 | 7/1967 |
| GB | 1405664 | 9/1975 |

OTHER PUBLICATIONS

Yang, H. et al. "Removal of Organic Nitrogen Compounds in LCO Reduce Hydrodesulfurization Severity", *Natl. Center for Upgrading Technology; SPE Intl. Thermal Operations and Heavy Oil Symposium Proceedings* (Society of Petroleum Engineers, SPE SPE/PS-CIM/CHOA Intl. Thermal Operations and Heavy Oil Symposium), Calgary, AB 20051101-20051103) 2005/—p. 1-8 (2005) Paper No. 97658.

Hurley, M. et al. "Light Oil: Clean Gasoline" Engelhard Corporation; Flying J; UOP LLC; ExxonMobil Res. and Engineering Co.; Merichem Chemical/Refinery Services; Davison Catalysts; ABB Lummus Global Inc.; Conoco Phillips; Roddey Engineering Services, In.; Ondeo Nalco Energy Service; Aspen Technology; Flint Hills Resources LP; Chevron USA; Packinox Inc. Pall Corp.; ATOFINA Petrochemicals, Inc. Fluor; Kellogg Brown and Root, Inc.; Mustang Engineering; *NPRA Questions and Answer Session on Refining and Petrochemical Technology Q and A transcripts: Refining Excellence*, Philadelphia, PA 20021015-20021018) 27 p (2002) Abstract Only.

YPF S.A., Argentina, "Clean Fuel Production" *International Journal of Hydrocarbon Engineering* V2 N.1 2-4, pp. 6-8 (Jan.-Feb. 1997).

Nat, P.J. et al. "Mild and Conventional Hydrocracking: Process Conditions, Products and Catalysts" *Akzo Chemie BV, Kuwait Inst. for Scientific Research et al., Conference* (Kuwait Mar. 5-8, 1989) Studies in Surface Science and Catalysis . . . Catalysts in Petroleum Refining 1989 V53 pp. 399-415 (1990).

* cited by examiner

*Primary Examiner* — Jill Warden
*Assistant Examiner* — Randy Boyer
(74) *Attorney, Agent, or Firm* — James C. Paschall

(57) ABSTRACT

Methods are disclosed for the hydrotreating and hydrocracking of highly aromatic distillate feeds such as light cycle oil (LCO) to produce ultra low sulfur gasoline and diesel fuel. Optimization of hydrotreater severity improves the octane quality of the gasoline or naphtha fraction. In particular, the operation of the hydrotreater at reduced severity to allow at least about 20 ppm by weight of organic nitrogen into the hydrocracker feed is shown to lead to these important benefits. Post-treating of the hydrocracker effluent over an additional hydrotreating catalyst bed may be desired to meet specifications for ultra low sulfur fuel components.

11 Claims, 2 Drawing Sheets

COMBINATION OF MILD HYDROTREATING AND HYDROCRACKING FOR MAKING LOW SULFUR DIESEL AND HIGH OCTANE NAPHTHA

FIELD OF THE INVENTION

The present invention relates to methods for converting petroleum distillates, such as highly aromatic feedstocks, using a combination of mild hydrotreating and hydrocracking to provide diesel and naphtha products, especially ultra low sulfur diesel and high octane naphtha.

DESCRIPTION OF RELATED ART

Petroleum refiners produce desirable products such as diesel fuel, naphtha, and gasoline, by hydrocracking a hydrocarbon feedstock, normally derived from crude oil. Distillate feedstocks often subjected to hydrocracking are gas oils and heavy gas oils recovered from crude oil by distillation. For example, U.S. Pat. No. 4,943,366 discloses a hydrocracking process for converting highly aromatic, substantially dealkylated feedstock into high octane gasoline.

Refiners also subject distillate hydrocarbon streams to hydrotreating operations such as hydrodesulfurization. To achieve currently mandated standards for ultra low sulfur diesel and gasoline, hydrotreating is being performed under high severity conditions, including high temperatures and pressures and low space velocities. The ability to upgrade the distillate known as Light Cycle Oil (LCO), obtained from fluid catalytic cracking (FCC) refinery operations, is of particular interest in view of the limited uses of this low-value material. However, high severity LCO hydrotreating often leads to excessive hydrogen consumption with only modest diesel quality upgrade in terms of cetane improvement.

There is consequently a demand for new hydroprocessing methods which can effectively upgrade distillate feedstocks such as LCO to more highly valuable products including diesel and naphtha. Ideally, these products, and especially diesel, should have a sufficiently low sulfur content to meet applicable standards. Naphtha should have a sufficiently high octane number for use in gasoline blending.

SUMMARY OF THE INVENTION

Embodiments of the invention relate to the finding that the quality of hydrocarbon products that are upgraded by subjecting a distillate feedstock to a combination of hydrotreating and hydrocracking can be further improved when an amount of organic nitrogen (e.g., at least about 20 parts per million by weight) is present in the feed (e.g., a hydrotreated distillate) to hydrocracking. The organic nitrogen in the hydrocracker feed may be added to this feed or otherwise result from reducing the severity of an upstream hydrotreating catalyst bed or zone, thereby allowing organic nitrogen to "slip" or pass to a subsequent hydrocracking catalyst bed or zone. In particular, without being bound by theory, it is believed that organic nitrogen beneficially suppresses the hydrogenation function of the hydrocracking catalyst, thereby increasing aromatic retention in the upgraded hydrocarbon product and consequently improving the quality (e.g., octane number) of the naphtha fuel component of this product. Importantly, the retained aromatics are generally mono-ring alkyl benzene compounds, having desirable octane values, which result from the cracking of 2-ring and multi-ring aromatic compounds present in the distillate feedstock. The ability of organic nitrogen to attenuate hydrogenation advantageously limits losses of aromatics to their less-valuable, corresponding cycloalkanes.

The nitrogen in the hydrotreated distillate, or effluent from the hydrotreating operation, may be controlled by controlling the hydrotreating severity for a given distillate feedstock, having a particular amount of organic nitrogen initially present. For example, hydrotreating severity may be reduced, allowing for a comparatively greater amount of organic nitrogen to pass to a downstream hydrocracking catalyst bed or zone, by lowering the pressure and/or inlet temperature of the hydrotreating catalyst bed or zone, increasing throughput (i.e., liquid hourly space velocity) through this bed or zone, or a combination of these operating parameter adjustments. In many cases, and particularly in those involving the hydroprocessing of distillate feedstocks having a high sulfur content, a reduction in hydrotreating severity may be accompanied by an increase in organic sulfur in the hydrocracked product (or hydrocracker effluent) obtained from hydrocracking. Further hydrotreating this product in a post-treatment step or zone can reduce sulfur levels in the resulting upgraded hydrocarbon product, in order to meet ultra low sulfur diesel and ultra low sulfur gasoline requirements.

These and other embodiments relating to the present invention are apparent from the following Detailed Description.

DETAILED DESCRIPTION

Figure 1:
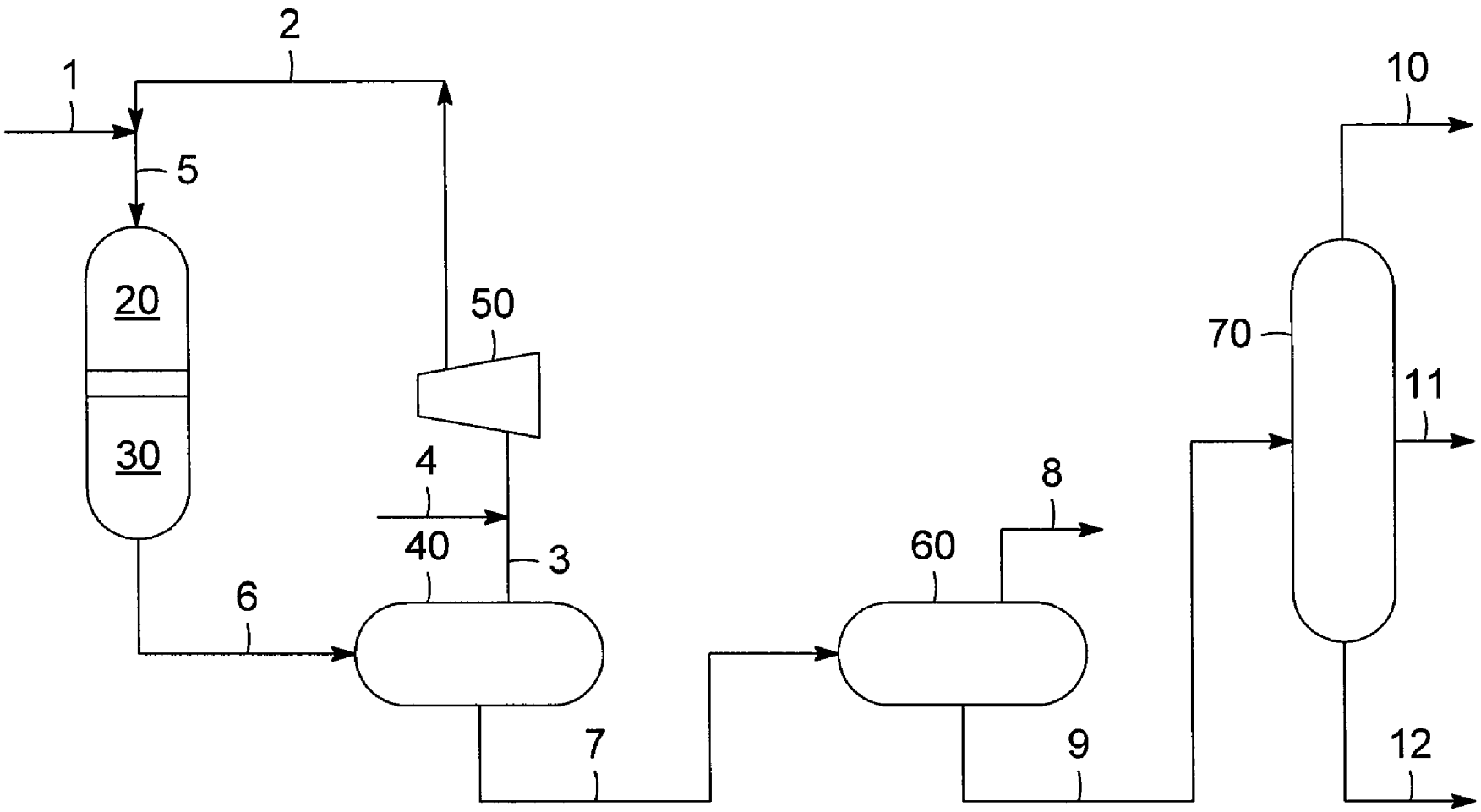
FIG. 1 depicts a representative process involving hydrotreating followed by hydrocracking in successive reactor zones, for the production of diesel fuel and naphtha.

Embodiments of the invention relate to the use of mild hydrotreating in combination with hydrocracking to upgrade a distillate feedstock. Representative methods comprise hydrotreating a distillate feedstock under mild hydrotreating conditions to produce a hydrotreated distillate and hydrocracking the hydrotreated distillate. A distillate feedstock is generally a distillable petroleum derived fraction having a boiling point range which is above that of naphtha. Suitable distillate feedstocks that may be obtained from refinery fractionation and conversion operations and that may be hydroprocessed in this manner include middle distillate hydrocarbon streams, such as highly aromatic hydrocarbon streams. Distillate feedstocks to the hydrotreating catalyst bed or zone include distillate hydrocarbons boiling at a temperature greater than about 149° C. (300° F.), typically boiling in the range from about 149° C. (300° F.) to about 399° C. (750° F.), and often boiling in the range from about 204° C. (400° F.) to about 371° C. (700° F.).

Representative distillate feedstocks include various other types of hydrocarbon mixtures, such as straight-run fractions, or blends of fractions, recovered by fractional distillation of crude petroleum. Such fractions produced in refineries include coker gas oil and other coker distillates, straight run gas oil, deasphalted gas oil, and vacuum gas oil. These fractions or blends of fractions can therefore be a mixture of hydrocarbons boiling in range from about 343° C. (650° F.) about 566° C. (1050° F.), with boiling end points in other embodiments being below about 538° C. (1000° F.) and below about 482° C. (900° F.). Thus, distillate feedstocks are often recovered from crude oil fractionation or distillation operations, and optionally following one or more hydrocarbon conversion reactions. However, distillate feedstocks may be utilized from any convenient source such as tar sand extract (bitumen) and gas to liquids conversion products, as well as synthetic hydrocarbon mixtures such as recovered from shale oil or coal.

Highly aromatic, substantially dealkylated hydrocarbons, especially suitable as distillate feedstocks, are produced during fluid catalytic cracking (FCC) of vacuum gas oils to produce high octane gasoline boiling range hydrocarbons. FCC is a thermally severe process which is operated without the presence of added hydrogen to reject carbon to coke and to produce residual fractions. During catalytic cracking, the high molecular weight feedstock disproportionates into relatively hydrogen-rich light liquids and aromatic, hydrogen-deficient heavier distillates and residues. Catalytic cracking in the absence of hydrogen does not provide significant desulfurization, nor are the sulfur- and nitrogen-containing compounds of the FCC feed selectively rejected with the coke. These sulfur and nitrogen compounds therefore concentrate in heavier cracked products that are produced in significant quantities and characterized as being highly aromatic, hydrogen-deficient middle and heavy distillates with high sulfur and nitrogen levels. One such product is known in the refining industry as Light Cycle Oil (LCO), which is often characterized in the industry as a "cracked stock" or "cracked stock boiling in the distillate range." References throughout this disclosure to a "distillate" or a "distillate feedstock" are therefore understood to include converted hydrocarbon products, such as LCO, having boiling ranges that are representative of distillate fractions.

Highly aromatic distillate feedstocks such as LCO therefore comprise a significant fraction of polyaromatics such as 2-ring aromatic compounds (e.g., fused aromatic rings such as naphthalene and naphthalene derivatives) as well as multi-ring aromatic compounds. Typically, the combined amount of 2-ring aromatic compounds and multi-ring aromatic compounds is at least about 40% by weight, normally at least about 60% by weight, and often at least about 70% by weight, of the distillate feedstock, whereas the amount of mono-ring aromatic compounds (e.g., benzene at benzene derivatives such as alkylaromatic compounds) typically represents at most about 40% by weight, normally at most about 25% by weight, and often at most about 15% by weight, of the distillate feedstock.

Distillate feedstocks also normally contain organic nitrogen compounds and organic sulfur compounds. For example, LCO and other distillate feedstocks typically contain from about 0.1% to about 4%, normally from about 0.2% to about 2.5%, and often from about 0.5% to about 2%, by weight of total sulfur, substantially present in the form of organic sulfur compounds such as alkylbenzothiophenes. Such distillate feedstocks also generally contain from about 100 ppm to about 2%, and normally from about 100 ppm to about 750 ppm, by weight of total nitrogen, substantially present in the form of organic nitrogen compounds such as non-basic aromatic compounds including cabazoles. A representative distillate feedstock such as LCO will therefore contain about 1% by weight of sulfur, about 500 parts per million (ppm) by weight of nitrogen, and greater than about 70% by weight of 2-ring and multi-ring aromatic compounds. The recycle of such liquids, including heavy and light cycle oils, from catalytic cracking, to the catalytic cracker is not an attractive option. Present market requirements make refractory product streams such as LCO particularly difficult to dispose of as commercially valuable products. LCO is a not a satisfactory diesel fuel blending component due to its poor engine ignition performance and its high sulfur.

As discussed above, it has now been surprisingly determined that carrying out hydrotreating of distillate feedstocks and particularly highly aromatic distillates such as LCO under conditions that allow the passage of organic nitrogen compounds (i.e., without complete removal/conversion of these compounds in the hydrotreated distillate) provides important benefits in subsequent hydrocracking. In particular, a hydrotreated distillate having at least about 20 ppm by weight (wt-ppm) of organic nitrogen, can beneficially improve the octane number of naphtha that may be recovered by fractionation from the upgraded hydrocarbon product after hydrocracking. Depending on the particular hydrocracker feed and hydrocracking catalyst system, it is often desired that this organic nitrogen content of the hydrotreated distillate is in the range from about 20 wt-ppm to about 100 wt-ppm. Other representative ranges for this organic nitrogen content are from about 20 wt-ppm to about 80 wt-ppm and from about 20 wt-ppm to about 60 wt-ppm, as measured by chemiluminescence.

The improvement in the quality of the upgraded hydrocarbon product obtained after all or a portion of the hydrotreated distillate is subsequently hydrocracked (e.g., in the presence of a hydrocracking catalyst that is different from an upstream hydrotreating catalyst in the same or a different reactor), may result from the beneficial attenuation of hydrogenation activity of the hydrocracking catalyst, thereby providing an increased yield of mono-ring alkylaromatic compounds having high octane values (and consequently a decreased yield of corresponding alkylcycloparaffinic compounds having relatively lower octane values). These mono-ring alkylaromatics are generally recovered as naphtha after downstream fractionation of the upgraded hydrocarbon product, for example into the fuel components of naphtha and diesel fuel. In an alternative embodiment of the invention in which the same advantages in terms of improvements in hydrocracking performance are realized, the hydrotreated distillate may be combined with another hydrocarbon stream, such that the resulting, combined stream, as a hydrocracker feed, has an organic nitrogen content as described above.

The inventive processes are even more broadly directed to the hydrocracking of hydrocarbon streams normally used as hydrocracker feeds in refinery operations (e.g., gas oils such as straight run gas oil or VGO), wherein the hydrocracker feed has an organic nitrogen content as described herein to improve the hydrocracker catalyst performance. The hydrocracker may be, but is not necessarily, pretreated, for example via hydrotreating as discussed above to obtain this organic nitrogen content. Other pretreatment steps to reduce the organic nitrogen content include, for example, contacting the hydrocracker feed with a solid adsorbent (guard bed) to selectively adsorb organic nitrogen compounds.

Hydrotreating conditions suitable for causing the desired amount of nitrogen to "slip" to a downstream hydrocracking catalyst bed or zone will vary depending on the distillate feedstock composition, and particularly its nitrogen content, that is hydroprocessed according to methods of the invention. Typical mild hydrotreating conditions include an average hydrotreating catalyst bed temperature from about 260° C. (500° F.) to about 426° C. (800° F.), often from about 316° C. (600° F.) to about 426° C. (800° F.), and a hydrogen partial pressure from about 4.1 MPa (600 psig) to about 10.5 MPa (1500 psig), often from about 6.2 MPa (800 psig) to about 8.3 MPa (1400 psig). In addition to pressure and temperature, the residence time of the distillate feedstock in the hydrotreating catalyst bed or zone can also be conveniently adjusted to increase or decrease the extent of organic nitrogen conversion and consequently the amount of organic nitrogen present in the hydrotreated distillate. With all other variables unchanged, lower residence times lead to lower conversion levels. The inverse of the residence time is closely related to a variable known as the Liquid Hourly Space Velocity (LHSV, expressed in units of $hr^{-1}$), which is the volumetric liquid flow rate over the catalyst bed divided by the bed volume and represents the equivalent number of catalyst bed volumes of liquid processed per hour. Thus, increasing the LHSV or distillate feedstock flow rate directionally decreases residence time and the conversion of compounds present in the feedstock, including organic nitrogen compounds. A typical range of LHSV for mild hydrotreating according to the present invention is from about 0.1 $hr^{-1}$ to about 10 $hr^{-1}$, often from about 0.5 $hr^{-1}$ to about 3 $hr^{-1}$.

In the hydrotreating catalyst bed or zone, the distillate feedstock is contacted with a hydrotreating catalyst to provide a hydrotreated distillate, usually having an organic nitrogen content (e.g., at least about 20 ppm) as discussed above, which can improve the performance of the hydrocracking catalyst used to process this hydrotreated distillate. Normally, the distillate feedstock is combined with a hydrogen-containing gas stream prior to contacting the hydrotreating catalyst. Most often, this hydrogen-containing gas stream is a combined recycle hydrogen gas stream, which is generally the combination of (i) a hydrogen-rich gas stream recovered from a downstream gas/liquid separation, and (ii) a relatively smaller amount of a fresh make-up hydrogen stream added to restore the amount of hydrogen consumed in hydrotreating and/or hydrocracking reactions and also lost from the process as dissolved hydrogen.

Suitable hydrotreating catalysts include those comprising of at least one Group VIII metal, such as iron, cobalt, and nickel (e.g., cobalt and/or nickel) and at least one Group VI metal, such as molybdenum and tungsten, on a high surface area support material such as a refractory inorganic oxide (e.g., silica or alumina). A representative hydrotreating catalyst therefore comprises a metal selected from the group consisting of nickel, cobalt, tungsten, molybdenum, and mixtures thereof (e.g., a mixture of cobalt and molybdenum), deposited on a refractory inorganic oxide support (e.g., alumina).

The Group VIII metal is typically present in the hydrotreating catalyst in an amount ranging from about 2 to about 20 weight percent, and normally from about 4 to about 12 weight percent, based on the volatile-free catalyst weight. The Group VI metal is typically present in an amount ranging from about 1 to about 25 weight percent, and normally from about 2 to about 25 weight percent, also based on the volatile-free catalyst weight. A volatile-free catalyst sample may be obtained by subjecting the catalyst to drying at 200-350° C. under an inert gas purge or vacuum for a period of time (e.g., 2 hours), so that water and other volatile components are driven from the catalyst.

Other suitable hydrotreating catalysts include zeolitic catalysts, as well as noble metal catalysts where the noble metal is selected from palladium and platinum. It is within the scope of the invention to use more than one type of hydrotreating catalyst in the same or a different reaction vessel. Two or more hydrotreating catalyst beds of the same or different catalyst and one or more quench points may be utilized in a reaction vessel or vessels to provide the hydrotreated distillate that is subjected to hydrocracking.

As discussed above, the source of the organic nitrogen in the hydrotreated distillate is normally the residual portion or unconverted amount of organic nitrogen that is initially present in the distillate feedstock. Typically, therefore, mild hydrotreating is carried out with an organic nitrogen conversion in the hydrotreating catalyst bed or zone of at least about 40%, normally in the range from about 50% to about 97%, and often in the range from about 75% to about 95%. It is also possible to obtain a desired about (e.g., at least about 20 ppm by weight, or in the range from about 20 ppm by weight to about 60 ppm by weight) of organic nitrogen in the feed to the hydrocracking zone by combining all or a portion of the effluent from the hydrotreating zone with another hydrocarbon stream (e.g., an LCO stream or a hydrotreated LCO stream) such that the amount of organic nitrogen in the combined feed to the hydrocracking zone is in these ranges. The main consideration is that the feed to the hydrocracking catalyst bed or zone (i.e., the hydrocracker feed, whether this feed is solely the hydrotreated distillate or a portion thereof, or otherwise a combination of the hydrotreated distillate and another hydrocarbon stream, or a different hydrocarbon stream such as a guard-bed treated hydrocarbon), has an amount of organic nitrogen as described above.

In the hydrocracking catalyst bed or zone, at least a portion, and normally all, of the hydrotreated distillate (effluent from the hydrotreating zone or hydrotreater effluent), optionally in combination with another hydrocarbon stream as discussed above, is contacted, as a hydrocracker feed, with a hydrocracking catalyst to provide an upgraded hydrocarbon product. The upgraded hydrocarbon product may correspond to the effluent from the hydrocracking zone or hydrocracker effluent, or otherwise may be the hydrocracker effluent after having undergone additional steps, such as an additional hydrotreating step to further reduce sulfur content. The hydrocracker feed may be contacted with an additional hydrogen-containing gas stream prior to or during contact with the hydrocracking catalyst. If the hydrocracker feed is a stream resulting from a combination of components, namely the hydrotreated distillate and another hydrocarbon stream, the additional hydrogen-containing gas may be mixed initially with one of the components of this combination, prior to the components being mixed to provide the hydrocracker feed. In general, however, the hydrogen-containing gas stream introduced to the upstream hydrotreating catalyst bed or zone provides sufficient hydrogen partial pressure to carry out the hydrocracking conversion reactions needed to upgrade the hydrocracker feed to a desired degree, such that no additional hydrogen-containing gas is required to the inlet of the hydrocracking catalyst bed or zone.

The hydrocracker feed, in many cases consisting of the entire hydrotreated distillate, preferably has an organic nitrogen content (e.g., at least about 20 ppm by weight) as discussed above, found to improve the performance of the hydrocracking catalyst (e.g., by attenuating loss of desired mono-ring aromatics through hydrogenation) and consequently the quality of the upgraded hydrocarbon product. As a result of being hydrocracked, the upgraded hydrocarbon product has a reduced average molecular weight relative to the hydrocracker feed. For example, in the case of a hydrotreated distillate, where the distillate feedstock prior to hydrotreating is predominantly 2-ring aromatic compounds and multi-ring aromatic compounds as discussed above, the upgraded hydrocarbon product may comprise at least about 40% by weight, and often at least about 50% by weight, mono-ring aromatic compounds. In a preferred embodiment, the upgraded hydrocarbon product comprises or consists essentially of a mixture of the fuel components naphtha and diesel fuel. Also, due to desulfurization resulting from upstream hydrotreating of all or a portion of the hydrocracking feed (i.e., the portion of the hydrocracking feed that is the hydrotreated distillate), the upgraded hydrocarbon product may comprise or consist essentially of naphtha and diesel fuel that meet sulfur specifications for ultra low sulfur naphtha (or ultra low sulfur gasoline blend stock) and ultra low sulfur diesel (or ultra low sulfur diesel blend stock).

Hydrocracking of the hydrocracker feed as described above may be carried out in the presence of a hydrocracking catalyst and hydrogen. Representative hydrocracking conditions include an average hydrocracking catalyst bed temperature from about 260° C. (500° F.) to about 426° C. (800° F), often from about 316° C. (600° F.) to about 426° C. (800° F.); a hydrogen partial pressure from about 4.1 MPa (600 psig) to about 10.5 MPa (1500 psig), often from about 6.2 MPa (800 psig) to about 8.3 MPa (1400 psig); an LHSV from about 0.1 $hr^{-1}$ to about 30 $hr^{-1}$, often from about 0.5 $hr^{-1}$ to about 3 $hr^{-1}$; and a hydrogen circulation rate from about 2000 standard cubic feet per barrel (337 normal $m^3/m^3$) to about 25,000 standard cubic feet per barrel (4200 normal $m^3/m^3$), often from about 5000 standard cubic feet per barrel (840 normal $m^3/m^3$) to about 15,000 standard cubic feet per barrel (2530 normal $m^3/m^3$).

Suitable catalysts for use in the hydrocracking catalyst bed or zone to provide an upgraded hydrocarbon product as described above include those comprising a metal selected from the group consisting of nickel, cobalt, tungsten, molybdenum, and mixtures thereof, deposited on a zeolite. According to a specific embodiment, the hydrocracking catalyst comprises such a metal or combination of metals as a hydrogenation component, deposited on a beta zeolite having a silica to alumina molar ratio of less than 30:1 and an $SF_6$ adsorption capacity of at least 28%, as described in U.S. Pat. No. 7,169,291, incorporated by reference with respect to its disclosure of catalysts useful in hydrocracking processes described therein. The beneficial effects of organic nitrogen in the hydrocracker feed, in terms of naphtha octane enhancement as disclosed herein, are particularly applicable to hydrocracking catalysts having a beta zeolite support. Other representative zeolites for hydrocracking catalyst supports, for which the advantageous results, as described herein, may be obtained include Y zeolite and MFI zeolite. The structures of Y zeolite and MFI zeolite are described, and further references are provided, in Meier, W. M, et al., *Atlas of Zeolite Structure Types,* $4^{th}$ Ed., Elsevier: Boston (1996).

Fractionation of the upgraded hydrocarbon product (after separation of recycle hydrogen and possibly other stages of light ends or heavy ends removal) can therefore yield naphtha and diesel, either or both of which typically have a sulfur content of less than about 30 ppm by weight, normally less than about 20 ppm by weight, and often less than about 10 ppm by weight. Depending on product needs, which govern the fractionation conditions, the distillation end point temperature of the naphtha may vary. For example, a relatively light naphtha may be separated from the upgraded hydrocarbon product, having a distillation end point temperature of about 149° C. (300° F.) (e.g., from about 138° C. (280° F.) to about 160° C. (320° F.)). According to other embodiments, a relatively heavy naphtha may be separated, having a distillation end point temperature of about 204° C. (400° F.) (e.g., from about 193° C. (380° F.) to about 216° C. (420° F.)). The naphtha itself may be fractionated into one or more naphtha fractions, for example light naphtha, gasoline, and heavy naphtha, with representative distillation end points being in the ranges from about 138° C. (280° F.) to about 160° C. (320° F.), from about 168° C. (335° F.) to about 191° C. (375° F.), and from about 193° C. (380° F.) to about 216° C. (420° F.), respectively. In any naphtha or naphtha fraction characterized as discussed above with respect to its distillation end point temperature, a representative "front end" or initial boiling point temperature is about 85° C. (185° F.) (e.g., from about 70° C. (158° F.) to about 100° C. (212° F.)).

According to representative embodiments of the invention, the yield of naphtha (having a distillation initial boiling point and/or end point in any of the ranges described above, is generally at least 30% by weight (e.g., from about 30% to about 65% by weight), normally at least about 35% by weight (e.g., from about 35% to about 55% by weight), and often at least about 40% by weight (e.g., from about 40% to about 50% by weight), of the combined yield of naphtha and heavier materials, including diesel fuel.

Advantageously, the integration of a number of features discussed above, including the feedstock, hydrotreating conditions and catalyst, hydrocracking conditions and catalyst, and a hydrocracker feed (which is in many cases corresponds to the entire hydrotreated distillate) containing at least about 20 ppm by weight of organic nitrogen, results in fuel components meeting desired sulfur tolerances and naphtha or a naphtha fraction that additionally has a high Research Octane Number (RON) (ASTM D2699). For any naphtha fuel component, including the naphtha naphtha fractions discussed above with respect to their initial boiling point and distillation end point temperatures, the RON will generally be at least about 85 (e.g., from about 85 to about 95), and preferably at least about 89 (e.g., from about 89 to about 93).

Aspects of the invention are therefore associated with the hydrocracking of feedstocks having an organic nitrogen content as described above. This organic nitrogen content may be obtained wholly or partially from upstream hydrotreating. If hydrotreating is used, the hydrotreating zone or catalyst bed and the hydrocracking zone or catalyst bed may be in a single reactor or reaction zone, such that the hydrotreating and hydrocracking steps are performed in a hydrotreating zone and a hydrocracking zone, respectively, of a single reactor. Otherwise, separate reactors may be employed, depending on the need to carry out hydrotreating and hydrocracking under different operating conditions (e.g., total pressure or hydrogen partial pressure) and/or the need to add or remove streams (e.g., hydrogen or hydrocarbons) between the hydrotreating and hydrocracking zones or catalyst beds. Hydrotreating may likewise follow hydrocracking in the same reactor or a separate reactor, such that the effluent from the hydrocracking zone or hydrocracker effluent is hydrotreated to reduce the sulfur content of the upgraded hydrocarbon product and consequently its fuel components. The use of post-treating of the hydrocracker effluent in one or more further hydrotreating steps may therefore help achieve the specified sulfur tolerances for the naphtha and/or diesel fuel components (e.g., less than about 10 ppm by weight for each component) of the upgraded hydrocarbon product.

According to a specific embodiment, therefore, the distillate feedstock is subjected to (a) hydrotreating in the presence of a hydrotreating catalyst as discussed above, (b) hydrocracking in the presence of a hydrocracking catalyst as discussed above, and (c) post-treating a hydrocracker effluent obtained in (b) in a further hydrotreating step to reduce the ultimate sulfur content in the upgraded hydrocarbon product. The post-treating step may use the same hydrotreating catalyst as in (a) (and as discussed above) or utilize a different hydrotreating catalyst.

A representative process flowscheme illustrating a particular embodiment for carrying out the methods described above is depicted in FIG. 1. FIG. 1 is to be understood to present an illustration of the invention and/or principles involved. As is readily apparent to one of skill in the art having knowledge of the present disclosure, methods according to various other embodiments of the invention will have configurations, components, and operating parameters determined, in part, by the specific feedstocks, products, and product quality specifications.

According to the embodiment illustrated in FIG. 1, a distillate feedstock stream 1 such as LCO is added to a combined recycle gas stream 2 that is a mixture of a hydrogen-rich gas stream 3 recovered from a high pressure separator 40 and fresh make-up hydrogen stream 4. As shown, both the recovered, hydrogen-rich gas stream 3 and fresh make-up hydrogen stream 4 are fed to the suction or inlet of recycle compressor 50. The combined feed stream 5 is then contacted with hydrotreating catalyst in hydrotreating zone 20 and subsequently with hydrocracking catalyst in hydrocracking zone 30. As noted above, conditions in hydrotreating zone 20 are generally such that the hydrotreated distillate (effluent from hydrotreating zone 20), which in the embodiment depicted in FIG. 1 serves entirely as feed to hydrocracking zone 30 (since both hydrotreating zone 20 and hydrocracking zone 30 are in a single reactor), allow the passage of at least about 20 ppm by weight of organic nitrogen to hydrocracking zone 30 to improve the hydrocracking catalyst performance and especially the quality of naphtha produced as a fuel component.

The total effluent stream 6 from hydrocracking zone 30 may be further subjected to hydrotreating using the same or a different hydrotreating catalyst and/or using the same or a different reactor, as used in hydrotreating zone 20, to further reduce sulfur in the ultimately-recovered liquid portion of this total effluent which is the upgraded hydrocarbon product. If no such post-treating is employed, the total effluent stream 6 will comprise, as a liquid portion, the effluent from hydrocracking zone 30 (or hydrocracker effluent), which is then recovered as the upgraded hydrocarbon product. As illustrated in the embodiment shown in FIG. 1, the total effluent stream 6 is sent to high pressure separator 40 to recover a hydrogen-rich gas stream 3. In many cases, the total effluent stream 6 from hydrocracking zone 30 is contacted with an aqueous stream (not shown) to dissolve ammonium salts (e.g., ammonium chloride) formed in hydrotreating zone 20 and/or hydrocracking zone 30 and that can condense as solid byproduct on cooler surfaces. This aqueous stream is then removed from high pressure separator 40 as a separate aqueous effluent stream.

High pressure separator 40 is generally operated at substantially the same pressure as in hydrocracking zone 30 and at a temperature from about 38° C. (100° F.) to about 71° C. (160° F.). Hydrogen-rich gas stream 3 normally provides the majority of the total hydrogen in combined recycle gas stream 2, with the hydrogen consumed in hydrotreating zone 20 and hydrocracking zone 30 (and lost through dissolution) being replaced by fresh make-up hydrogen stream 4.

Liquid hydrocarbon product 7 from high pressure separator 40 may then be subjected to one or more additional separations, for example in low pressure separator 40 which removes, in off gas stream 8, small amounts of hydrogen dissolved in liquid hydrocarbon product 7 as well as light hydrocarbons (e.g., cracked products) and other light gases such as hydrogen sulfide. In the embodiment according to FIG. 1, upgraded hydrocarbon product 9 is recovered as a liquid from low pressure separator 40 and routed to fractionator 70 for recovery of fuel components. One or several distillation columns may be used to recover naphtha, diesel fuel, and other fuel components, depending on the distillate feedstock processed and desired product slate. In some cases, it may be desired to recover a multitude of fuel components using fractionation, for example, the total yield of naphtha having a 204° C. (400° F.) end point may be used for gasoline blending or otherwise fractionated into light naphtha, gasoline, and heavy naphtha.

According to the embodiment illustrated in FIG. 1, upgraded hydrocarbon product 9 is fractionated into a liquefied petroleum gas stream 10, a naphtha stream 11, and a diesel fuel stream 12. As a result of optimization of conditions in hydrotreating zone 20 and hydrocracking zone 30, and particularly the use of (i) mild hydrotreating conditions that allow for at least about 20 ppm by weight of organic nitrogen to pass to from hydrotreating zone 20 to the inlet of hydrocracking zone 30 and optionally (ii) the post-treating of the effluent from hydrocracking zone 30 to further remove sulfur, the naphtha stream 11 and diesel fuel stream 12 are generally very low in sulfur. Preferably, the naphtha stream 11 and diesel fuel stream 12 each have sulfur contents of less than about 10 ppm, respectively, to meet specifications for ultra low sulfur gasoline and ultra low sulfur diesel fuel. Moreover, naphtha stream 11 is a high quality gasoline blending component as a result of attenuated hydrogenation functionality in hydrocracking zone 30. Preferably, naphtha stream 11 has a RON of at least about 85 and is normally in the range from about 86 to about 95.

Overall, aspects of the invention are directed to the use of mild hydrotreating conditions in combination with hydrocracking and optionally post-treating to optimize the quality of fuel components of the upgraded hydrocarbon product obtained from these processes. The presence of organic nitrogen in the feed to hydrocracking improves the quality of the hydrocracker effluent, upgraded hydrocarbon product, and/or fuel component(s) (as discussed above), relative to the quality of the same hydrocracker effluent, upgraded hydrocarbon and/or fuel component(s) obtained with the same hydrocracking process but in the absence or substantial absence (e.g., less than about 1 ppm by weight) of organic nitrogen in the feed.

In view of the present disclosure, it will be seen that several advantages may be achieved and other advantageous results may be obtained. Those having skill in the art will recognize the applicability of the methods disclosed herein to any of a number of hydrotreating and/or hydrocracking processes, and especially in the case of distillate feeds having a high content of multi-ring aromatic compounds. Those having skill in the art, with the knowledge gained from the present disclosure, will recognize that various changes could be made in the above processes without departing from the scope of the present disclosure. Mechanisms used to explain theoretical or observed phenomena or results, shall be interpreted as illustrative only and not limiting in any way the scope of the appended claims.

The following examples are set forth as representative of the present invention. These examples are not to be construed as limiting the scope of the invention as these and other equivalent embodiments will be apparent in view of the present disclosure and appended claims.

EXAMPLE 1

Figure 2:
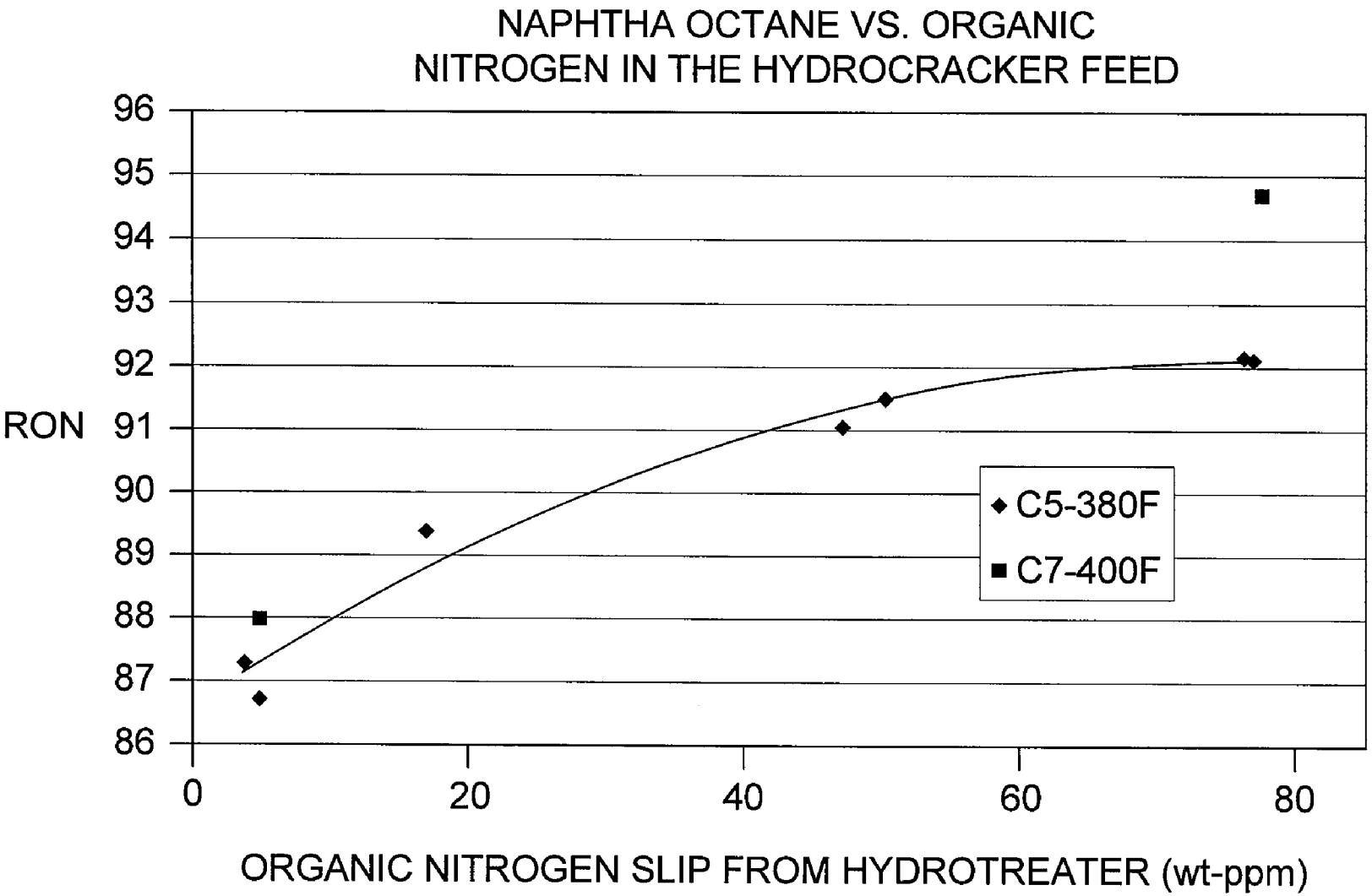
FIG. 2 illustrates the improvement in Research Octane Number (RON) of gasoline obtained from hydrocracking of Light Cycle Oil (LCO), as the amount of organic nitrogen in the hydrocracker feed is increased by reducing the severity of upstream hydrotreating.

LCO hydrocracking was used to produce high octane gasoline. A reduction in upstream hydrotreating severity, by lowering temperature, lowering pressure, increasing LHSV, and/or introducing a higher severity (e.g., more refractory) feed, was found to improve octane over a range of operating conditions. FIG. 2 illustrates the effect of organic nitrogen "slip" (allowing organic nitrogen to pass from the hydrotreater to the hydrocracker) on gasoline octane, as demonstrated in pilot plant testing results. In particular, increasing the slip of organic nitrogen compounds to the hydrocracker showed as much as a 7 RON improvement, with the most significant effect observed when the organic nitrogen slip is in the range from about 20 to 60 ppm by weight.

The results in FIG. 2 demonstrate that the optimization of hydrotreater severity is an important parameter in improving gasoline octane. The improvement obtained by allowing organic nitrogen to pass to the hydrocracker was observed for naphtha or gasoline fractions having distillation endpoints of 193° C. (380° F.) and 204° C. (400° F.). Overall, the experimental results showed that increasing organic nitrogen slip from the hydrotreater to the hydrocracker can lead to a several RON improvement. This may be caused by suppression of hydrogenation functionality of the hydrocracking catalyst and consequently increased retention of mono-ring aromatic compounds (e.g., alkyl benzenes). The above results also demonstrate that a proper balance between hydrotreating and hydrocracking conditions (e.g., temperature) can be used to provide components meeting low sulfur specifications and additionally, in the case of naphtha, high RON requirements.

The invention claimed is:

1. A method for making ultra low sulfur diesel and ultra low sulfur gasoline, the method comprising (a) hydrotreating a Light Cycle Oil (LCO) feedstock under mild hydrotreating conditions to provide a hydrotreated LCO containing from about 20 to about 100 parts per million by weight (wt-ppm) of organic nitrogen, and (b) hydrocracking the hydrotreated LCO in the presence of a hydrocracking catalyst comprising a metal selected from the group consisting of nickel, cobalt, tungsten, molybdenum, and mixtures thereof, deposited on a zeolite selected from the group consisting of a Y zeolite, a beta zeolite, and an MFI zeolite, to obtain a hydrocracked product, (c) hydrotreating the hydrocracked product to provide an upgraded hydrocarbon product having a reduced sulfur content, and (d) fractionating the upgraded hydrocarbon product into (i) naphtha having a distillation end point temperature from about 149° C. (300° F.) to about 204° C. (400° F.), a Research Octane Number (RON) of at least about 85, and sulfur content of less than about 10 wt-ppm, and (ii) diesel fuel having a sulfur content of less than about 10 wt-ppm.

2. The method of claim 1, wherein the LCO feedstock comprises at least about 40% by weight of 2-ring aromatic compounds and multi-ring aromatic compounds combined.

3. The method of claim 1, wherein the distillate feedstock comprises at most about 40% of mono-ring aromatic compounds.

4. The method of claim 1, wherein the hydrotreating step is carried out in the presence of a hydrotreating catalyst and the mild hydrotreating conditions include an average hydrotreating catalyst bed temperature from about 316° C. (600° F.) to about 426° C. (800° F.), a hydrogen partial pressure from about 6.2 MPa (800 psig) to about 8.3 MPa (1400 psig), and a liquid hourly space velocity (LHSV) from about 0.5 $hr^{-1}$ to about 3 $hr^{-1}$.

5. The method of claim 4, wherein the hydrotreating catalyst comprises a metal selected from the group consisting of nickel, cobalt, tungsten, molybdenum, and mixtures thereof, on a refractory inorganic oxide support.

6. The method of claim 1, wherein the upgraded hydrocarbon product comprises at least about 50% by weight of mono-ring aromatic compounds.

7. The method of claim 1, wherein the upgraded hydrocarbon product comprises a fuel component selected from the group consisting of naphtha, diesel fuel, and mixtures thereof.

8. The method of claim 1, wherein hydrocracking is carried out in the presence of a hydrocracking catalyst and hydrogen, at an average hydrocracking catalyst bed temperature from about 316° C. (600° F.) to about 426° C. (800° F.), a hydrogen partial pressure from about 6.2 MPa (800 psig) to about 8.3 MPa (1400 psig), an LHSV from about 0.5 to about 3 $hr^{-1}$, and a hydrogen circulation rate from about 5000 standard cubic feet per barrel (840 normal $m^3/m^3$) to about 15,000 standard cubic feet per barrel (2530 normal $m^3/m^3$).

9. The method of claim 1, wherein the zeolite is a beta zeolite.

10. The method of claim 1, further comprising (c) post-treating a hydrocracker effluent obtained in step (b) in a further hydrotreating step, whereby the upgraded hydrocarbon product has a sulfur content of less than about 10 wt-ppm.

11. The method of claim 1, further comprising hydrocracking the entire hydrotreated LCO.

* * * * *